US006644278B2

(12) United States Patent
Harndorf

(10) Patent No.: US 6,644,278 B2
(45) Date of Patent: Nov. 11, 2003

(54) PRESSURE CONTROLLED INJECTOR FOR INJECTION SYSTEMS WITH HIGH PRESSURE COLLECTING AREA

(75) Inventor: Horst Harndorf, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 10 days.

(21) Appl. No.: 09/999,528

(22) Filed: Nov. 15, 2001

(65) Prior Publication Data

US 2002/0092502 A1 Jul. 18, 2002

(30) Foreign Application Priority Data

Nov. 29, 2000 (DE) ..... 100 59 124

(51) Int. Cl.[7] ..... F02M 33/04
(52) U.S. Cl. ..... 123/446; 123/447
(58) Field of Search ..... 123/456, 446, 123/447, 514, 457, 458

(56) References Cited

U.S. PATENT DOCUMENTS 5,732,679 A * 3/1998 Takahasi et al. ..... 123/467
6,092,509 A * 7/2000 Tanabe et al. ..... 123/447
6,112,721 A * 9/2000 Kouketsu et al. ..... 123/447
6,192,862 B1 * 2/2001 Tanabe et al. ..... 123/447
6,363,914 B1 * 4/2002 Tanabe et al. ..... 123/447

FOREIGN PATENT DOCUMENTS

DE 197 01 879 A1 7/1998
EP 0 657 642 A2 6/1995

* cited by examiner

*Primary Examiner*—Thomas N. Moulis
(74) *Attorney, Agent, or Firm*—Michael J. Striker

(57) ABSTRACT

The invention concerns an injection system for the injection of fuel into the combustion chambers of combustion engines. The injection system embraces a high pressure collecting area (5) (Common Rail), which is supplied across a high pressure pump (3) and provides fuel under high pressure to a number (n−1) of injectors (6, 21). The individual injectors 6, 21 each possess an injection nozzle (23) which is opened and closed by means of a vertically moveable nozzle pin (22). In a high pressure conduit (12) disposed after the high pressure collecting area (5) and leading to the injectors (6, 21) there is provided a first flowthrough valve (7). A run-off conduit (25, 31) is operated by means of a further flowthrough valve (26) disposed close to the nozzle.

8 Claims, 3 Drawing Sheets

PRESSURE CONTROLLED INJECTOR FOR INJECTION SYSTEMS WITH HIGH PRESSURE COLLECTING AREA

BACKGROUND OF THE INVENTION

In the technology of injector systems for the injection of high pressure fuel into the combustion areas of direct-injection combustion engines, injector systems with high pressure collecting areas are employed. Pressure pulsations in the fuel can be dampened by means of the fuel volumes contained in the high pressure collecting area (Common Rail), and a uniformly high pressure level can be guaranteed for all of the injectors of the injection system. The start of injection and the amounts injected are adjusted by means of the electrically controllable injectors, which can be introduced at the cylinder heads of direct-injection combustion engines without substantial alterations.

EP 0 657 642 A2 discloses a fuel injection apparatus for fuel engines. These involve a high pressure collecting area fillable by a high pressure fuel pump, from which lead out high pressure conduits to the individual injection valves. Therewith are employed in the individual high pressure conduits, control valves for the control of the high pressure injection in the injection valves, as well as an additional reservoir area between these control valves and the high pressure collecting area. In order to avoid too high a system pressure being continuously fitted to the injection valves, the control valves are so executed that during the injection pauses at the injection valves, their connection to the reservoir area is locked and a connection between the injection valves and a relief area is set up.

DE 197 01 879 A1 also refers to a fuel injection apparatus for combustion engines. The solution from the state of the art disclosed by this reference is also the provision of a relief canal, which can be connected with a workspace hydraulically controllable by means of the control valve links, in order to thereby attain an adjustment of the timing position of the control valve links.

However, the need still exists as before to bring about a further decrease in both contaminant emissions and noise pollution from direct-injection combustion engines. Such advancements can be essentially complied with by means of an improved injector functioning. If a more simple construction of a pressure-controlled injector can be realized, then mastery of the production process for such injectors can be significantly increased so as to provide a higher degree of standardization during the production of the injectors. This would considerably influence the manufacturing costs of such injector systems.

With prevailing pressures of clearly more than 1400 bar within the fuel injection systems for direct-injection combustion engines, a further increase in the system pressure is obtainable only with difficulty. The pump conduits necessary for this inevitably lead to an increase in the dissipation losses that occur by means of the introduction of heat into the fuel. However, this is highly undesirable. On the other hand, the previously known injectors that have been utilized are constructed properly complex and require, for example, a drainage throttle and an input throttle, control pistons, sometimes a doubled pin guide and that sort of thing. In order to realize the desired construction characteristics in prepared injectors in a cost-favorable manner, expensive preparation steps are necessary which unfavorably influence the total manufacturing costs of such injectors.

The necessary activation of drainage and input throttles, with consideration of the injection tolerances, impairs the opening and closing behavior of today's injector constructions especially for the employment of high pressure collecting areas (Common Rail).

SUMMARY OF THE INVENTION

With both suggested variations in accordance with the present invention, either with or without utilization of the uniform pressure transmission unit, one obtains on the one hand a standardized cost-favorable preparation of injectors, taking into account the principles of construction economics. In addition to the elevation of pressure, one can further take advantage of the fuel volumes involved in the fuel injection. The increase in pressure, however, is only provided during the injection phase, so that leakages based upon irregularities in fuel viscosity and the overflow effects resulting therefrom, are not critical. In order to avoid an over-stressed injection rate during the ignition delay, occuring on account of the increase in pressure of the fuel injection, a throttle element for dampening of the injection rate can be positioned before the injector entrance. An excessive injection rate would clearly be the factor responsible for an elevation in noise level, as well as a rise in the amounts of NOx-emissions.

In addition to the increase in pressure effective only during the injection window, and the thereby improved safety of the injector with regard to the behavior of viscosity irregularities within the injector system, a greater opening and closing dynamic (rapid spill) can be attained by means of a 2/2-way valve close to the nozzle, which was previously not obtainable in these devices using throttle elements. Moreover, the injection interval between the preliminary injection phase and the subsequent main injection phase are considerably shortened, by means of the 2/2-way valve close to the nozzle, since shorter running times can then be obtained within the conduit system.

In order to be able to maintain a higher standard pressure within the fuel injection system, indeed depending upon the type of use, one need simply to integrate a pressure retaining valve, for example a uniform pressure valve.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The invention will be more closely illustrated with the help of the following drawings.

DESCRIPTION OF THE PREFERRED EMBODIMENTS

Figure 1:
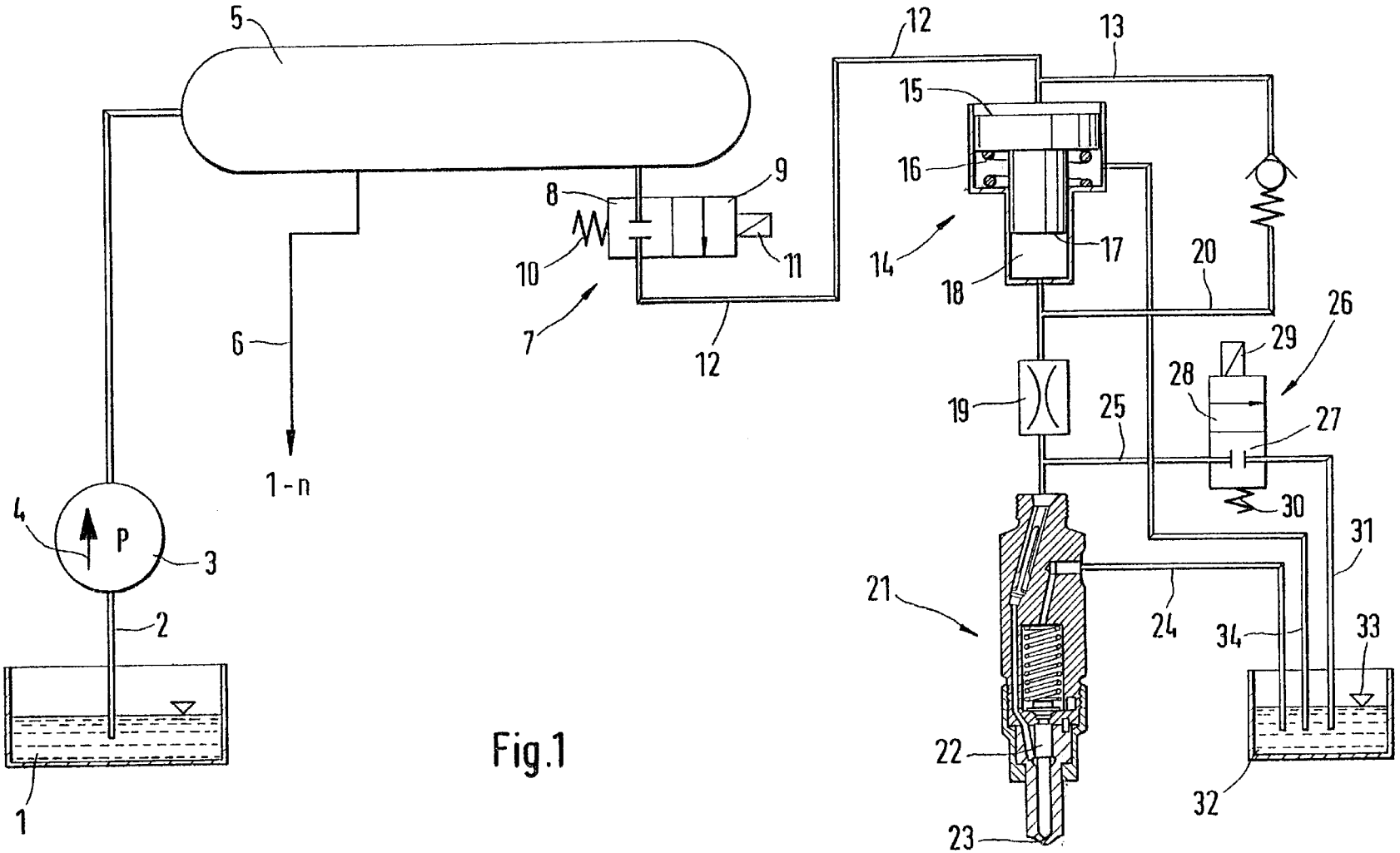
FIG. 1 discloses a 2/2-way valve, which is associated with a high pressure collecting area and is provided with a pressure translation unit that supplies an input throttle to the injector.

FIG. 1 of the drawings more closely illustrates a fuel injection system with a pressure translation unit having fixed gear ratio.

From fuel reservoir 1 there follows the sucking of fuel across a conduit 2 by means of a high pressure pump 3. The high pressure pump 3 for its part promotes the exit side move-ment of highly compressed fuel in output direction 4 to a high pressure collecting area 5 (Common Rail). From high pressure collecting area 5 there branches off a number (n−1) of conduits to the individual injection nozzles 23 displaying injectors 6, 21, depending on the number of cylinders in the combustion engine to be provided with direct injection.

Based upon the represented simplification, however, only one high pressure conduit 12 to an injector 21 in the representation according to FIG. 1, will be discussed in all details. The high pressure conduits 12 to the (n−1) further injectors 6, 21 of the combustion engine are constituted in analogous manner.

The high pressure collecting area 5 (Common Rail) supplies the individual high pressure conduits 12, which are situated from high pressure collecting area 5 to the injectors 6, 21 in the cylinder head area of a direct injection fuel engine, so that even with greater drawing of fuel in a high pressure conduit 12 through the thereby supplied injector 21, the pressure level in the high pressure collecting area 5 remains substantially constant. This succeeds by means of a correspondingly dimensioned fuel high pressure pump 3, which outputs the fuel from the fuel reservoir continuously into the high pressure collecting area 5. By means of the fuel volume contained in the interior of the high pressure collecting area 5, on the one hand, pressure pulsations in the fuel resulting from rapid, shock-like opening of the individual injectors is avoided. On the other hand, an extremely high level of prevailing pressure can be maintained by means of the storage volume of the high pressure collecting area 5.

Within a high pressure conduit 12 branching off from high pressure collecting area 5 there is provided a first flowthrough valve 7. The flowthrough valve 7 can be provided, for example, as a magnetic valve, which is configured as a 2/2-way valve. In the embodiment of the present invention represented in FIG. 1, the first pressure decreasing valve is shown in its locking position 8. The valve body of the first flowthrough valve 7 is operated by means of a magnet 11, which opposes the positioning force from a spring element 10 on the opposite side of the first flowthrough valve 7. Through use of the magnet 11, the first flowthrough valve 7 can be switched from its locking position 8 into a released position, which is designated in the representation according to FIG. 1 by reference numeral 9. When the first flowthrough valve 7 is connected, high pressure accumulates across the high pressure conduit 12 to a pressure translation unit 14 provided according to this particular embodiment, at the surface 15 (A1). The piston element of the translation unit 14 is supplied across a retro-spring 16; the lower surface A2, designated by reference numeral 17, limits a movable boundary of a pressure chamber 18, which is defined by the outer walls of the pressure translation unit 14. Parallel to the pressure translation unit 14 in the high pressure conduit 12 there is provided a return valve, the conduit sections of which are designated by reference numerals 13 and 20. Across these can be attained, on the one hand, a determined standing pressure in the high pressure conduit 12 during non-activation of injector 21; on the other hand, fuel volumes can be passed forward anew across the return valve within return circle 13, 20 across this conduit acting as a bypass conduit to the outflow side, i.e. to the pressure chamber 18 of the pressure translator 14. That is how the pressure equilibrium is maintained between the preliminary side, given as shown by surface 15 and the outflow side, represented by surface 17 of the pressure chamber 18 at the piston element of the pressure translation unit 14.

An input throttle element 19 is provided subsequent to the pressure translation unit 14 according to the embodiment of FIG. 1. By means of the throttle element 19, which is provided on the entering side of an injector 21, an over-stressing of the injection rate during the ignition delay phase, i.e. until the start of the combustion in the combustion chamber of a combustion engine, can be suppressed. The injection rate should be kept particularly low at the start of the ignition delay phase, in order to prevent impermissably excessive increases in both noise and NOx levels in the direct injection combustion engine.

Inside of injector 21, supplied across the input throttle 19 at its entering side, there is situated a nozzle pin 22, movable in a vertical direction, which on the one hand, is next to a spring element placed inside of the injector housing, and on the other hand, is enclosed by a nozzle chamber which is equipped with a pressure stage. When the nozzle chamber is supplied with fuel under high pressure, there arises at the pressure stage a force opposing the closing force from the thick spring, so that the nozzle pin 22 is driven upwardly in a vertical direction and an injection opening in injection nozzle 23 is released.

There is disposed after input throttle 19 positioned at the entry side relative to the injector 21, an off-control conduit 25, 31, in which is provided a further flowthrough valve 26. The flowthrough valve 26, which is disposed preferably, particularly close to the nozzle, in order to realize a short conduit pathway, can be formed, for example, across a magnet 29, which opposes a return force produced by means of a spring element 30. In the state of the system as represented in FIG. 1, the further flowthrough valve 26 is seen in its locking position 27, i.e. the off-control conduit 25, 31 stretching to a fuel reservoir 32, is closed. Upon activation of magnet 29 the further flowthrough valve 26 can be switched into its release position 28, so that the pressure level arising on the entry side of injector 21 can be very quickly (so-called rapid spill) adjusted out into the fuel tank 32 by means of this controlling of magnet 29 of further flowthrough valve 26. In addition there is provided for the injector housing a leakage conduit 24, with which overflowing volumes of fuel can be collected in the fuel reservoir 32. The pressure translation unit 14 is also provided with a leakage conduit, identified with reference numeral 34, across which excess volumes of fuel can likewise flow out into the fuel reservoir 32. With the embodiment according to the present invention as set forth in FIG. 1, the injection system can be cut off from high pressure during the injection pauses immediately at the exit from the high pressure collecting area 5 through operation of the first flowthrough valve 7. The injector 21 supplied from high pressure conduit 12 is thereby placed under high pressure exclusively only within the relevant injection window. The pressure elevation which adjusts at the pressure translation unit 14 following the operation of the first flowthrough valve 7 from its locked position 8 to its open position 9 takes place depending upon the constructive design of pressure translation unit 14 in a fixed defined ratio.

The controlling of the fuel which passes under high pressure from injector 21 occurs after conversion of the first flowthrough valve 7 from its open position 9 to its locked position 8. Thereupon follows an opening of the further flowthrough valve 26 from its locked position 27 into its open position 28, until the nozzle pin 22 of the injector 21 is pressed into the seat of the nozzle by means of the return force across the thick spring, and the injection nozzle 23 becomes locked. Simultaneously, there occurs a return of the translation piston of the pressure translation unit by means of the return spring 16 with displacement of the fuel, so that the translation piston assumes its starting position. Simultaneously there follows across the bypass conduit 13, 20 at the outflow side, i.e. the pressure side 18 of the translation unit 14, a building-up of a new volume of fuel, i.e. a pressure equilibrium between the upper surface 15 of the translation unit and the pressure chamber 18 of translation unit 14 provided across the translation piston.

By means of the arrangement close to the nozzle of the further flowthrough valve 26, which can be provided for example as a 2/2-way valve, an improvement in the opening and closing dynamic (rapid spill) of injector 21 is made possible. Thereby substantially shortened injection intervals between a pre-injection phase and a main injection phase can be attained, so that the most different requirements can be met as to the design of the injection behavior with the solution suggested in accordance with the present invention. By means of the interposition of a pressure translation unit 14 in the high pressure conduit 12 from the high pressure collecting area 5 to the injector 21, one can, moreover, decrease undesirable temperature elevation on account of dissipation losses upon compression of the fuel. Accordingly, by means of simply constructed measures, pressure elevations can be attained with the exclusion of the disadvantages that can occur with pressure elevation by means of a more greatly dimensioned high pressure pump.

Figure 2:
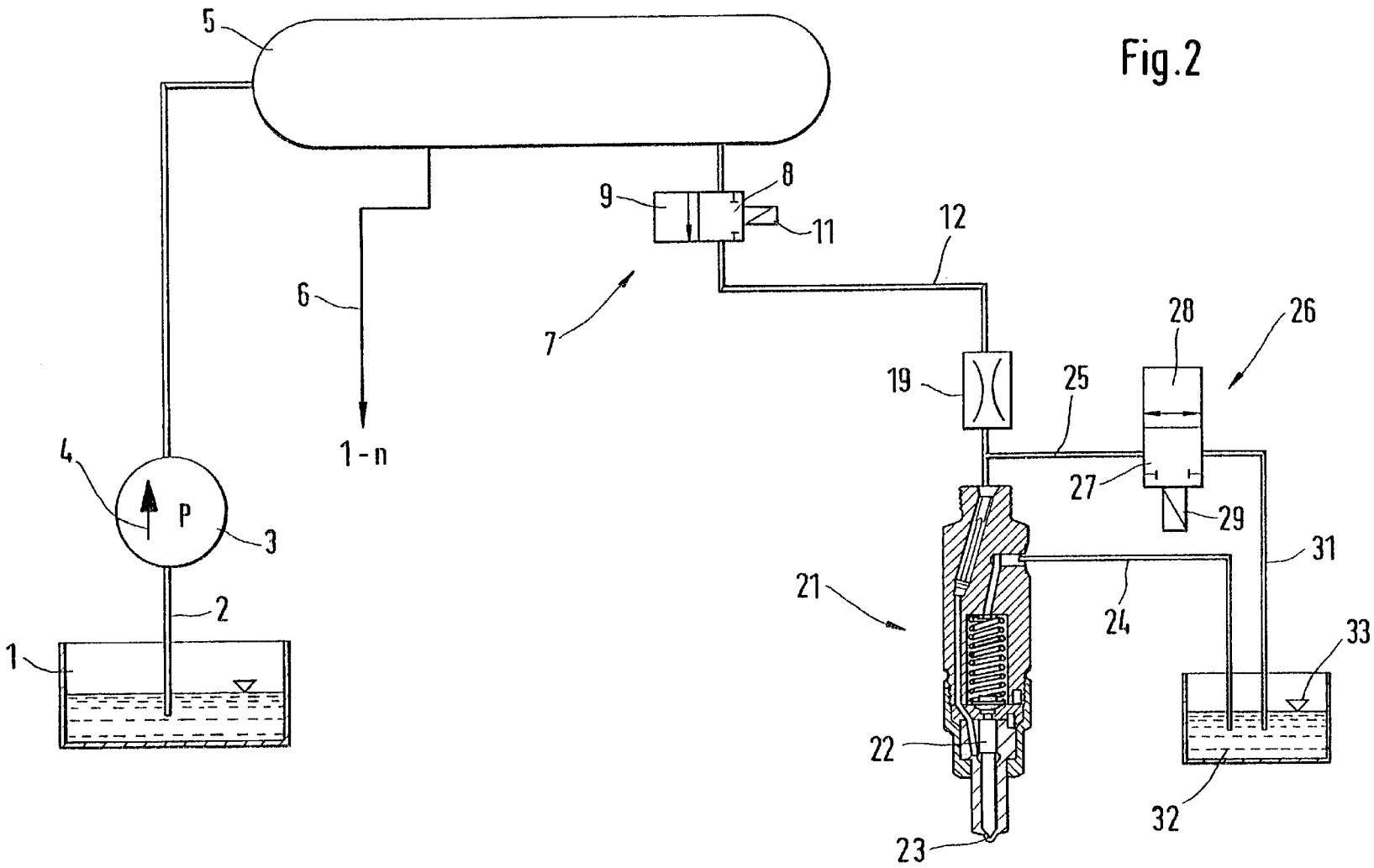
FIG. 2 is a further variation or embodiment, with which the input throttle which serves the injector is supplied directly across the 2/2-way valve.

The representation according to FIG. 2 discloses a further embodiment of the solution in accordance with the present invention, in which the injector is directly supplied at the entrance side with an input throttle across a pressure minimizing valve.

In accordance with this embodiment of a fuel injection system having higher opening and closing dynamics (rapid spill) the individual high pressure conduits 12 to the injectors 6, 21 in the cylinder head area of a direct injection combustion engine contain no pressure translation units 14. The pressure translation unit 14 can be integrated according to modular, sectional construction principles, in the high pressure conduit 12, when higher injection pressures need to be realized at the injection nozzle 23, of direct injection fuel engines, e.g. in high performance diesel vehicles or commercial utility vehicles. When a fuel injection system is needed which operates with a more moderate injection pressure level at the injection nozzle 23, an embodiment of the solution in accordance with the present invention as represented in FIG. 2 can be employed. Even with this embodiment, however, across a high pressure pump 3 in output direction 4 a high pressure collecting area 5 (Common Rail) is supplied with fuel under high pressure. Across the individual branches 6 a number 1-n of injectors, which corresponds to the number of cylinders of a direct injection combustion engine, are supplied with fuel under high pressure. In the individual conduits 12 to the individual injectors 21 in the cylinder head area of the direct injection combustion engine there is disposed the high pressure chamber side of a first flowthrough valve, which is formed preferably as a 2/2-way valve and is operated across magnet 11. The first flowthrough valve 7 can be switched back and forth from a locked position 8 into a free position 9. The high pressure conduit 12 can be connected across this, so that a throttle element 19 is provided at the entry side of the injector 21 with fuel under high pressure. The throttle element 19 serves for a prevention of an over-stressing of the injection rate within the ignition delay phase, during which an impermissibly high noise and NOx development can occur. Branch conduits 25 and 31 are represented, which branch out from high pressure conduit 12, which flow into a fuel reservoir 32. Within branch conduits 25, 31 there is integrated a further flowthrough valve 26, analogous to the representation of the injection system according to FIG. 1, which is preferably provided as a 2/2-way valve. This pressure decreasing valve is also brought by means of a magnet 29 from a locked position 27 into an open position 28. An off-flow conduit 24 is disposed to the housing of injector 21, across which leakage amounts of fuel arising in the injector housing can likewise be lead into the fuel reservoir 32.

With this embodiment according to the present invention the high pressure system can also be uncoupled from the high pressure by means of the first flowthrough valve 7 at the output of high pressure collecting area 5 during the injection pauses. The injector 21 supplied across high pressure conduit 12 is thereby utilized exclusively only during the relevant injection window, under high pressure. Excessive increases in pressure adjusting in the injection conduit, i.e. the high pressure conduit 12, can be exploited during the injection operation. When a higher standard pressure is desirable in the high pressure conduit 12, a pressure stopping valve, e.g. an equal pressure valve, not illustrated here, can be inserted. By means of the close to the nozzle arrangement of further flowthrough valve 26 a shortening of the time interval between a preliminary injection phase and a subsequent main injection phase can be obtained. A high opening and closing dynamic by means of a pressure relief within high pressure conduit 12 as well as injector 21 cannot be expected solely by means of a 3/2-way valve or a 2/2-way valve arranged at the exit of the high pressure collecting area 5 (Common Rail), because of the long running times in the conduit system.

Figure 3:
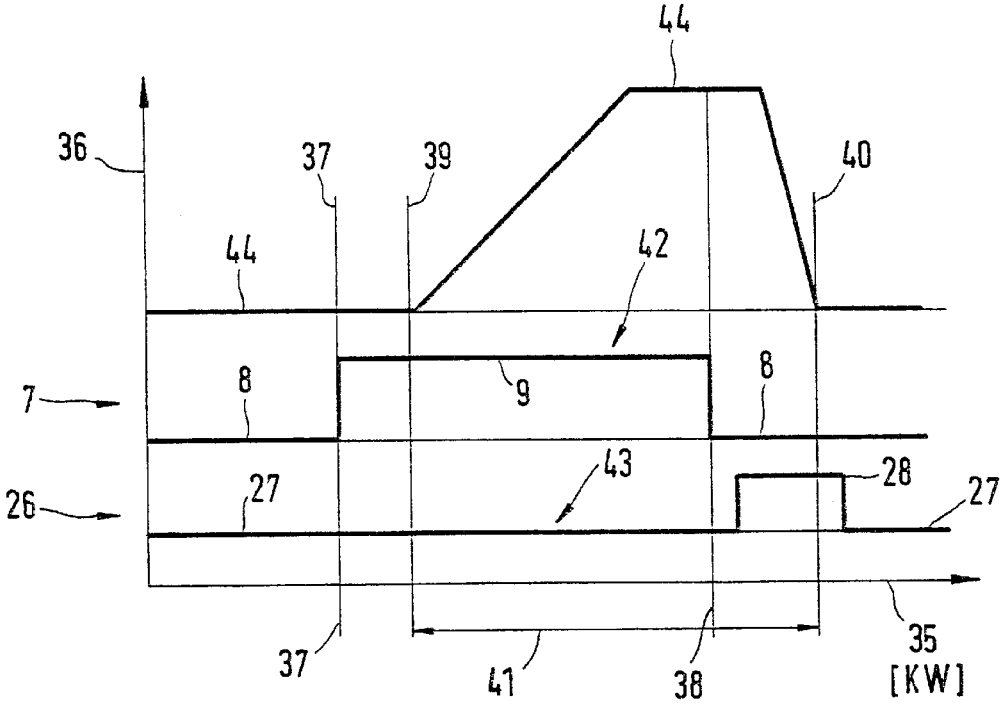
FIG. 3 is a graphic representation of the course of the nozzle pin pathway, and the switching state of the first and any further 2/2-way valves, always taken with reference to the crankshaft angle.

The representation according to FIG. 3 shows in graphic form the course of the nozzle pathway as well as the closed state of the pressure easing valves, always taken with reference to the crankshaft angle.

The first flowthrough valve 7 remains in its locked position 8 until the start of throughput 37, i.e. the high pressure conduit 12 involved which feeds injector 21 from high pressure collecting area 5 is closed. At the start of throughput the magnet 11 of the first flowthrough valve 7 is in operation. The valve goes from its locked position into its open position 9. After a time interval the start of injection follows at the injection nozzle 23 of the nozzle pin 22 with passed-through pressure flank. The nozzle pin 22 is run through the steadily climbing injection pressure to its seat and attains a pathway maximum until the end of the injection (reference numeral 38). At this point in time 38 the promotion of flow finishes, i.e. the first flowthrough valve 7 goes from its open position 9 into its locked position 8. During the time period until the closing of the first flowthrough valve 7 covering only a small degree of the crank shaft angle, the further flowthrough valve 26 disposed close to the nozzle opens from its closed state 27 into its open position 28. Thereby a rapid run-off operation into the subsequently disposed fuel reservoir 32 is introduced to off-control conduits 25, 31. During the interval between the end of throughput 38 and the start of the opening of further throughput valve 26 disposed close to the nozzle the elevation in pressure produced in high pressure conduit 12 is utilized for the injection during the operation of nozzle pin 22, i.e. the opening of injection nozzle 23. The end of injection is designated in FIG. 3 by reference numeral 40, at which point the first flowthrough valve 7 persists in its locked position 8, whereas to this point in time the second flowthrough valve 26, which is disposed close to the nozzle, is still open. During the open position 28 of further flowthrough valve 26 the injector can be further relieved of pressure after the end of throughput 40. Indeed depending upon which pressure level is desired in the fuel high pressure conduit 12 to injectors 6 through 21, the standing pressure in these conduits can be maintained by means of an equal pressure valve provided therein, which serves as a pressure retaining valve.

The injection systems configured according to the embodiments represented in FIGS. 1 and 2 allow for the broadest extent of standardized injector construction. Indeed depending upon need and the pressure level to be produced, pressure translation units 14 (FIG. 1) can be integrated into the system or omitted. In the injection systems configured in accordance with the present invention, the injectors 6, 21 remain under high pressure only during the injection phases. Safety and leakage are correspondingly non-critical. High opening and closing dynamics (rapid spill) can be realized. This is attained in particular by means of a further flowthrough valve 26 disposed close to the nozzle, through which follows a run-off of the injection volumes into the fuel reservoir 32. Moreover, with the injection systems configured in accordance with the present invention, the interval between the pre-injection phase and the main injection phase can be minimized by means of the arrangement close to the nozzle of the further flowthrough valve 26. During the injection operation the elevation of pressure which exists in the high pressure conduit 12 stretching from high pressure collecting area 5 can be better utilized for the injection.

It will be understood that each of the elements described above, or two or more together, may also find a useful application in other types of fuel injection systems differing from the types described above.

While the invention has been illustrated and described as embodied in a pressure controlled injector for injection systems with high pressure collecting area, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from that the standpoint of prior art, fairly constitute essential characteristics of the generic or specific aspects of this invention.

What is claimed as new and desired to be protected by Letters Patent is set forth in the appended claims.

I claim:

1. High-pressure fuel supply system for the injection of fuel into the combustion chambers of combustion engines of the type having a high pressure collecting the (5) which is supplied with pressure across a high pressure pump (3) and across which a plurality (n−1) of injectors (6, 21) are supplied with fuel under high pressure, and having a freely moveable nozzle (23) admitted into each individual injector (6, 21) which closes an injector nozzle (23), the improvement comprising a first flowthrough valve (7), a further flowthrough valve (26) and a run-off conduit (25, 31), said high pressure conduit (12) being connected with said run-off conduit (25, 31), said run-off conduit (25, 31) being disposed across said further flowthrough valve (26), said further flowthrough valve (26) being arranged in close proximity to said injection nozzle, and further comprising an input throttle element (19) disposed at the entry side of each (n−1) injectors (6, 21).

2. The injection system according to claim 1, wherein said flowthrough valves (7, 26) are provided as 2/2-way magnetic valves.

3. The injection system according to claim 1, further comprising a pressure hold valve is integrated into the high pressure conduit (12).

4. The injection system according to claim 1, further comprising a pressure translation unit (14), wherein said pressure translation unit (14) is disposed along with said flowthrough valve (7) on a side of the high pressure conduit (12) having the high pressure collecting area.

5. The injection system according to claim 4, further comprising a parallel conduit (13, 20) disposed parallel to said pressure translation unit (14), and a return valve disposed within said parallel conduit.

6. The injection system according to claim 4, said injector (6, 21) further comprising a seat, and wherein said further flowthrough valve (26) disposed close to said nozzle can be held in an open position (26) thereof until said nozzle pin (22) becomes pressed into said seat of said injector, and said pressure translation unit (14) has assumed its starting position.

7. The injection system according to claim 1, further comprising a reservoir (32), said run-off conduit (25, 31) flows into said reservoir and said further flowthrough valve (26) being arranged close to said nozzle favoring a rapid controlling of the system injection pressure across said run-off conduit and into said reservoir.

8. The injection system according to claim 1, wherein after an end of throughput (40) of the high pressure fuel both said flowthrough valves (6, 27) jointly operate in their respective closed positions (8, 27) during a small degree of crankshaft angle (35).

* * * * *